US010851787B2

(12) United States Patent
Mlsna et al.

(10) Patent No.: US 10,851,787 B2
(45) Date of Patent: Dec. 1, 2020

(54) COMPRESSOR BEARING HOUSING DRAIN

(71) Applicant: TRANE INTERNATIONAL INC., Davidson, NC (US)

(72) Inventors: Eric S. Mlsna, Cashton, WI (US); Scott J. Smerud, La Crosse, WI (US); Daniel R. Crum, Huntersville, NC (US); Scott M. Branch, Tomah, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 360 days.

(21) Appl. No.: 15/746,549

(22) PCT Filed: Jul. 21, 2016

(86) PCT No.: PCT/US2016/043331
§ 371 (c)(1),
(2) Date: Jan. 22, 2018

(87) PCT Pub. No.: WO2017/015456
PCT Pub. Date: Jan. 26, 2017

(65) Prior Publication Data

US 2018/0223852 A1 Aug. 9, 2018

Related U.S. Application Data

(60) Provisional application No. 62/195,395, filed on Jul. 22, 2015.

(51) Int. Cl.
*F04C 29/02* (2006.01)
*F04C 23/00* (2006.01)
(Continued)

(52) U.S. Cl.
CPC ..... *F04C 29/028* (2013.01); *F01C 21/02* (2013.01); *F04C 18/0215* (2013.01);
(Continued)

(58) Field of Classification Search
CPC .. F04C 29/028; F04C 18/0215; F04C 29/023; F04C 29/025; F04C 29/02; F04C 29/008; F25B 31/002
See application file for complete search history.

(56) References Cited

U.S. PATENT DOCUMENTS 4,666,381 A 5/1987 Butterworth
5,370,513 A 12/1994 Fain
(Continued)

FOREIGN PATENT DOCUMENTS

CN 1310301 A 8/2001
CN 1629490 A 6/2005
(Continued)

OTHER PUBLICATIONS

Extended European Search Report, European Patent Application No. 16828532.8, dated Feb. 21, 2019 (12 pages).
(Continued)

*Primary Examiner* — Deming Wan
(74) *Attorney, Agent, or Firm* — Hamre, Schumann, Mueller & Larson, P.C.

(57) ABSTRACT

A bearing housing drain in a scroll compressor and method for controlling lubrication of a thrust bearing in the scroll compressor are disclosed. The compressor includes a compressor housing; a non-orbiting scroll member and an orbiting scroll member; an orbiting scroll hub having an upper end and a lower end, the lower end being disposed at a vertical elevation that is lower than the upper end; a thrust bearing; a lubricant sump; a housing drain cavity disposed within the compressor housing and configured to receive lubricant from the lubricant sump and to deliver the lubricant to the thrust bearing; and a bearing housing drain fluidly connected to the housing drain cavity and the lubricant sump.

19 Claims, 4 Drawing Sheets

(51) Int. Cl.

| | |
|---|---|
| ***F01C 21/04*** | (2006.01) |
| ***F04C 18/02*** | (2006.01) |
| ***F25B 31/00*** | (2006.01) |
| ***F01C 21/02*** | (2006.01) |
| ***F25B 1/10*** | (2006.01) |
| ***F25B 31/02*** | (2006.01) |

(52) U.S. Cl.

CPC ..... *F04C 18/0253* (2013.01); *F04C 23/008* (2013.01); *F04C 29/023* (2013.01); *F04C 29/025* (2013.01); *F25B 1/10* (2013.01); *F25B 31/002* (2013.01); *F25B 31/02* (2013.01); *F04C 2240/30* (2013.01); *F04C 2240/50* (2013.01); *F04C 2240/603* (2013.01); *F04C 2240/809* (2013.01)

(56) References Cited

U.S. PATENT DOCUMENTS

| | | | |
|---|---|---|---|
| 5,660,539 | A | 8/1997 | Matsunaga et al. |
| 5,772,411 | A | 6/1998 | Crum et al. |
| 2004/0170509 | A1 | 9/2004 | Wehrenberg et al. |
| 2007/0003424 | A1 | 1/2007 | Benco et al. |
| 2008/0008613 | A1 | 1/2008 | Kim et al. |
| 2009/0238704 | A1* | 9/2009 | Sakamoto ..... F04C 18/0215 418/55.1 |
| 2014/0037474 | A1 | 2/2014 | Iitsuka et al. |

FOREIGN PATENT DOCUMENTS

| | | |
|---|---|---|
| JP | 2002-161880 | 6/2002 |
| WO | 2014/103204 | 7/2014 |

OTHER PUBLICATIONS

International Search Report and Written Opinion, International Patent Application No. PCT/US2016/043331, dated Oct. 12, 2016 (11 pages).

* cited by examiner

COMPRESSOR BEARING HOUSING DRAIN

FIELD

This disclosure relates generally to scroll compressors. More specifically, the disclosure relates to a bearing housing drain in a scroll compressor for controlling lubrication of a thrust bearing in the scroll compressor.

BACKGROUND

One type of compressor is generally referred to as a scroll compressor. Scroll compressors generally include a pair of scroll members which orbit relative to each other to compress air or a refrigerant. A typical scroll compressor includes a first, stationary scroll member having a base and a generally spiral wrap extending from the base and a second, orbiting scroll member having a base and a generally spiral wrap extending from the base. The spiral wraps of the first and second orbiting scroll members are interleaved, creating a series of compression chambers. The second, orbiting scroll member is driven to orbit the first, stationary scroll member by a rotating shaft. Some scroll compressors employ an eccentric pin on the rotating shaft that drives the second, orbiting scroll member.

SUMMARY

This disclosure relates generally to scroll compressors. More specifically, the disclosure relates to a bearing housing drain in a scroll compressor for controlling lubrication of a thrust bearing in the scroll compressor.

In some embodiments, the scroll compressor can be used in a refrigeration system to compress a heat transfer fluid.

In some embodiments, the scroll compressor can be used in a system other than a refrigeration system. In such embodiments, the scroll compressor can, for example, be used to compress air or gases other than a heat transfer fluid (e.g., natural gas, etc.).

In some embodiments the scroll compressor includes a housing drain cavity having a bearing housing drain. The bearing housing drain can be disposed at an angle relative to a horizontal axis. In some embodiments, the angle can be at or about zero degrees to at or about 65 degrees.

In some embodiments, a lubricant can be forced from the housing drain cavity through the bearing housing drain and returned to a lubricant sump when a compressor is in operation. In some embodiments, the lubricant can drain toward the housing drain cavity when the compressor is not in operation. Draining the lubricant toward the housing drain cavity can, in some embodiments, form a pool of lubricant which can be used upon compressor startup. In some embodiments, the pool of lubricant can provide lubrication to an orbiting scroll and thrust bearing of the compressor at a relatively quicker rate than if no pool of lubricant were formed. In some embodiments, this can increase a lifetime of the compressor. In some embodiments this can also reduce failure of components of the compressor due to insufficient lubrication.

A compressor is disclosed. The compressor includes a compressor housing; a non-orbiting scroll member and an orbiting scroll member; an orbiting scroll hub having an upper end and a lower end, the lower end being disposed at a vertical elevation that is lower than the upper end; a thrust bearing; a lubricant sump; a housing drain cavity disposed within the compressor housing and configured to receive lubricant from the lubricant sump and to deliver the lubricant to the thrust bearing; and a bearing housing drain fluidly connected to the housing drain cavity and the lubricant sump.

A heat transfer circuit is disclosed. The heat transfer circuit includes a compressor, a condenser, an expansion device, and an evaporator fluidly connected. The compressor includes a compressor housing; a non-orbiting scroll member and an orbiting scroll member; an orbiting scroll hub having an upper end and a lower end, the lower end being disposed at a vertical elevation that is lower than the upper end; a thrust bearing; a lubricant sump; a housing drain cavity disposed within the compressor housing and configured to receive lubricant from the lubricant sump and to deliver the lubricant to the thrust bearing; and a bearing housing drain fluidly connected to the housing drain cavity and the lubricant sump.

BRIEF DESCRIPTION OF THE DRAWINGS

References are made to the accompanying drawings that form a part of this disclosure and which illustrate embodiments in which the systems and methods described in this specification can be practiced.

Like reference numbers represent like parts throughout.

DETAILED DESCRIPTION

This disclosure relates generally to scroll compressors. More specifically, the disclosure relates to a bearing housing drain in a scroll compressor for controlling lubrication of a thrust bearing in the scroll compressor.

A bearing housing drain is generally included in a housing drain cavity of a scroll compressor. The bearing housing drain can prevent lubricant from filling the housing drain cavity, which can cause unwanted drag, which can result in efficiency loss. A vertical position of an inlet location of the bearing housing drain, a diameter of the bearing housing drain, and an angle at which the bearing housing drain is formed are useful design considerations for the bearing housing drain. For example, the vertical position of the inlet location can affect the ability and amount of lubricant pumped by the orbiting scroll bearing hub that pumps lubricant to the orbiting scroll thrust surface. The angle of the bearing housing drain can, for example, help control a level of lubricant pooled in the housing drain cavity at the time of compressor startup. Controlling the level of lubricant pooled in the housing drain cavity can create a lubricant source that is particularly useful at the time of compressor startup. The lubricant pooled in the housing drain cavity can advantageously reduce an amount of time of compressor operation before lubricant can be pumped to, for example, the orbiting scroll thrust surface, as compared to a scroll compressor without a pool of lubricant in the housing drain cavity in which the lubricant is pumped from the lubricant sump at the time of startup. In some embodiments, this can increase a lifetime of the compressor and/or reduce compressor failures. The angle of the bearing housing drain can also be selected to control an amount of lubricant within the housing drain cavity during a period of operation of the compressor.

Figure 1:
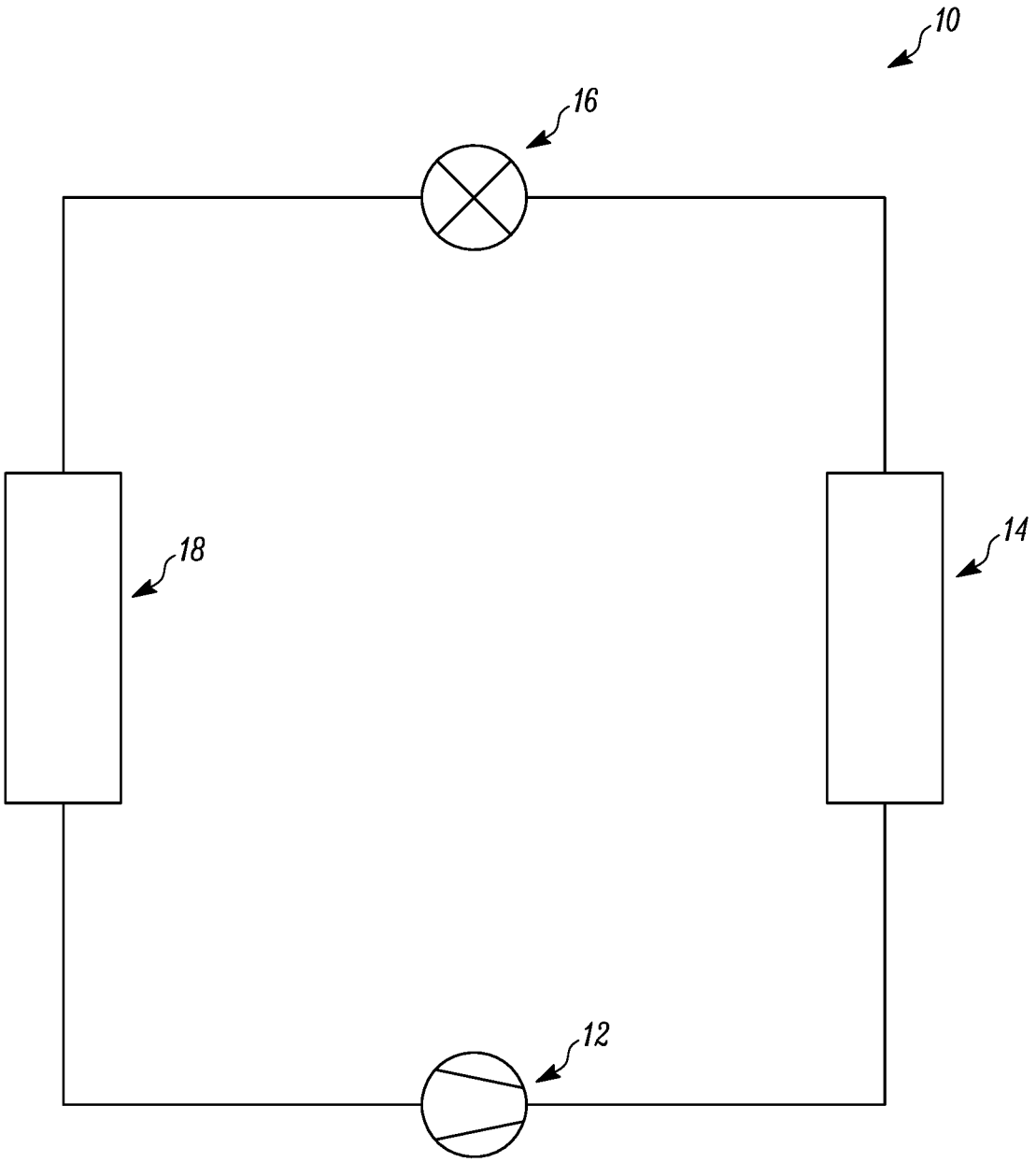
FIG. 1 is a schematic diagram of a heat transfer circuit, according to some embodiments.

FIG. 1 is a schematic diagram of a heat transfer circuit 10, according to some embodiments. The heat transfer circuit 10 generally includes a compressor 12, a condenser 14, an expansion device 16, and an evaporator 18. The compressor 12 can be, for example, a scroll compressor such as the scroll compressor shown and described in accordance with FIG. 2 below. The heat transfer circuit 10 is exemplary and can be modified to include additional components. For example, in some embodiments the heat transfer circuit 10 can include an economizer heat exchanger, one or more flow control devices, a receiver tank, a dryer, a suction-liquid heat exchanger, or the like.

The heat transfer circuit 10 can generally be applied in a variety of systems used to control an environmental condition (e.g., temperature, humidity, air quality, or the like) in a space (generally referred to as a conditioned space). Examples of systems include, but are not limited to, heating, ventilation, and air conditioning (HVAC) systems, transport refrigeration systems, or the like.

The components of the heat transfer circuit 10 are fluidly connected. The heat transfer circuit 10 can be specifically configured to be a cooling system (e.g., an air conditioning system) capable of operating in a cooling mode. Alternatively, the heat transfer circuit 10 can be specifically configured to be a heat pump system which can operate in both a cooling mode and a heating/defrost mode.

Heat transfer circuit 10 operates according to generally known principles. The heat transfer circuit 10 can be configured to heat or cool heat transfer fluid or medium (e.g., a liquid such as, but not limited to, water or the like), in which case the heat transfer circuit 10 may be generally representative of a liquid chiller system. The heat transfer circuit 10 can alternatively be configured to heat or cool a heat transfer medium or fluid (e.g., a gas such as, but not limited to, air or the like), in which case the heat transfer circuit 10 may be generally representative of an air conditioner or heat pump.

In operation, the compressor 12 compresses a heat transfer fluid (e.g., refrigerant or the like) from a relatively lower pressure gas to a relatively higher-pressure gas. The relatively higher-pressure and higher temperature gas is discharged from the compressor 12 and flows through the condenser 14. In accordance with generally known principles, the heat transfer fluid flows through the condenser 10 and rejects heat to a heat transfer fluid or medium (e.g., water, air, etc.), thereby cooling the heat transfer fluid. The cooled heat transfer fluid, which is now in a liquid form, flows to the expansion device 16. The expansion device 16 reduces the pressure of the heat transfer fluid. As a result, a portion of the heat transfer fluid is converted to a gaseous form. The heat transfer fluid, which is now in a mixed liquid and gaseous form flows to the evaporator 18. The heat transfer fluid flows through the evaporator 18 and absorbs heat from a heat transfer medium (e.g., water, air, etc.), heating the heat transfer fluid, and converting it to a gaseous form. The gaseous heat transfer fluid then returns to the compressor 12. The above-described process continues while the heat transfer circuit is operating, for example, in a cooling mode (e.g., while the compressor 12 is enabled).

Figure 2:
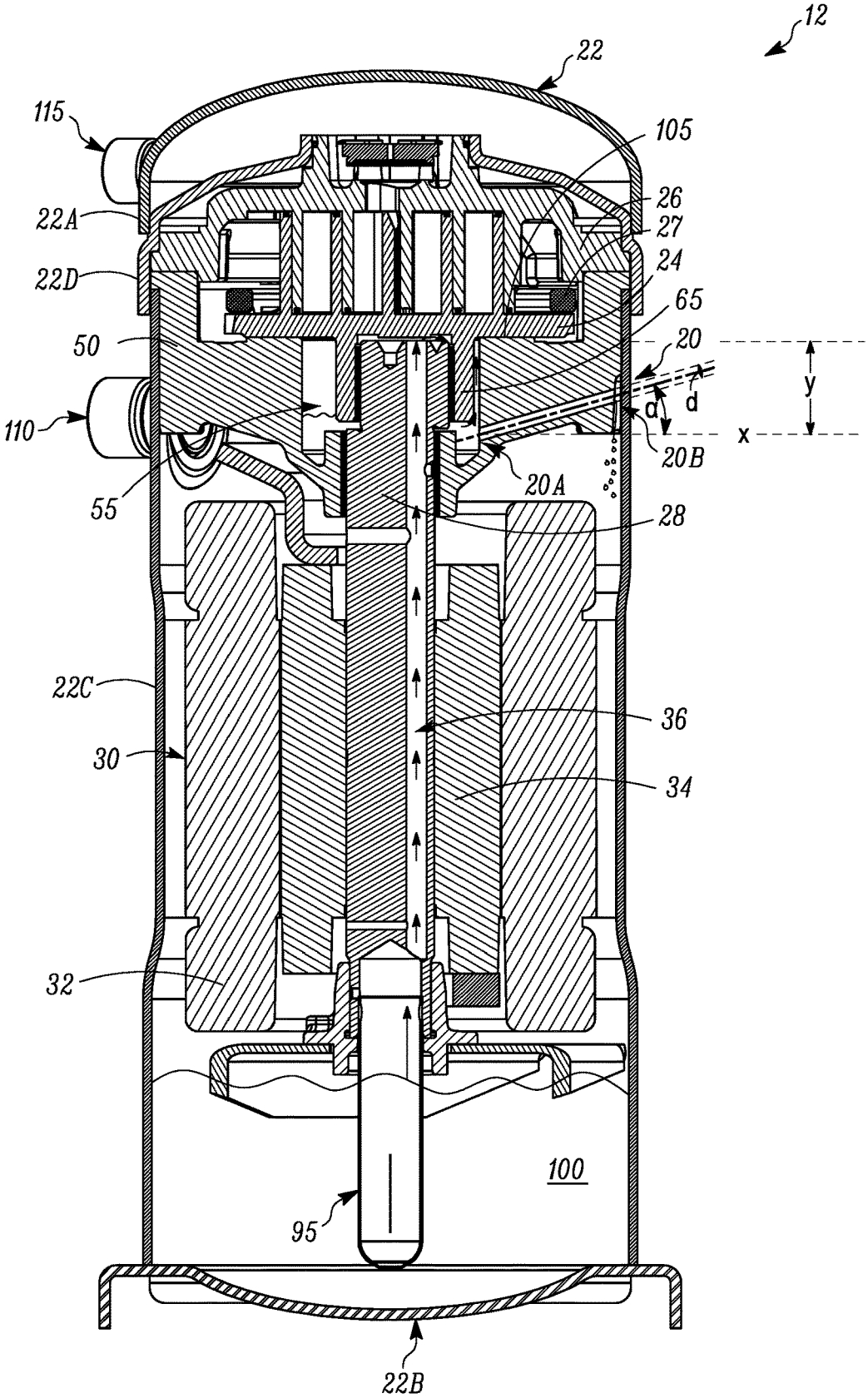
FIG. 2 illustrates a scroll compressor having an angled bearing housing drain, according to some embodiments.

FIG. 2 illustrates the compressor 12 having a bearing housing drain 20, according to some embodiments. The compressor 12 can be used in the heat transfer circuit 10 of FIG. 1. It is to be appreciated that the compressor 12 can also be used for purposes other than in a heat transfer circuit. For example, the scroll compressor 12 can be used to compress air or gases other than a heat transfer fluid (e.g., natural gas, etc.). It is to be appreciated that the scroll compressor 12 may include one or more additional features. For example, the scroll compressor 12 can include one or more filters for filtering the lubricant to prevent contaminants (e.g., metal or the like) from being introduced to the features being lubricated.

The illustrated compressor 12 is a single-stage scroll compressor. More specifically, the illustrated compressor 12 is a single-stage vertical scroll compressor. It is to be appreciated that the principles described in this specification are not intended to be limited to single-stage scroll compressors and that they can be applied to multi-stage scroll compressors having two or more stages.

The compressor 12 is illustrated in cross-sectional side view. The scroll compressor 12 includes a hermetically sealed housing 22. The housing 22 includes an upper portion 22A, a lower portion 22B, a middle portion 22C, and an intermediate portion 22D. It will be appreciated that the compressor 12 may not include the intermediate portion 22D (sometimes alternatively referred to as the intermediate cap 22D). The compressor 12 includes a suction inlet 110 and a discharge outlet 115.

The compressor 12 includes an orbiting scroll 24 and a non-orbiting scroll 26. The non-orbiting scroll 26 can alternatively be referred to as, for example, the stationary scroll 26, the fixed scroll 26, or the like. The non-orbiting scroll 26 is aligned in meshing engagement with the orbiting scroll 24 by means of an Oldham coupling 27.

The compressor 12 includes a driveshaft 28. The driveshaft 28 can alternatively be referred to as the crankshaft 28. The driveshaft 28 can be rotatably driven by, for example, an electric motor 30. The electric motor 30 can generally include a stator 32 and a rotor 34. The driveshaft 28 is fixed to the rotor 34 such that the driveshaft 28 rotates along with the rotation of the rotor 34. The electric motor 30, stator 32, and rotor 34 operate according to generally known principles. The driveshaft 28 can, for example, be fixed to the rotor 34 via an interference fit or the like.

The driveshaft 28 includes an opening 36. The opening 36 can alternatively be referred to as the lubricant passage 36, according to some embodiments. The opening 36 is fluidly connected to the lubricant sump 100 and an upper main housing 50. In operation, lubricant can be provided from the lubricant sump 100 to the components (e.g., thrust bearing 105, orbiting scroll 24, etc.) of the upper main housing 50 via the opening 36. To enable the flow of lubricant, a lubricant pump 95 extends into the lubricant sump 100. The lubricant pump 95 is fixed to a lower end of the driveshaft 28. As a result, the lubricant pump 95 can pump lubricant from the lubricant sump 100 via centrifugal force when the driveshaft 28 rotates. The lubricant pump 95 operates according to generally known principles.

The main upper housing 50 includes a housing drain cavity 55. The housing drain cavity 55 builds up lubricant received from the opening 36. The built-up lubricant provides lubrication to the thrust bearing 105, orbiting scroll 24, and the like in the main upper housing 50. The thrust bearing 105 generally can receive lubricant which is pushed by the orbiting scroll hub 65 against the walls of the housing drain cavity 55 until it reaches the thrust bearing 105.

To prevent too much lubricant from building up in the housing drain cavity 55, the housing drain cavity 55 includes the bearing housing drain 20. The bearing housing drain 20 is fluidly connected to the housing drain cavity 55. The bearing housing drain 20 can prevent an excess amount of lubricant from building up in the housing drain cavity 55, which may cause excessive drag.

An inlet end 20A of the bearing housing drain 20 receives the lubricant from the housing drain cavity 55. In the illustrated embodiment, the inlet end 20A of the bearing housing drain 20 is disposed a distance y from a bottom surface of the thrust bearing 105, which is vertically lower than a lower end of the orbiting scroll hub 65. It will be appreciated that the distance y can be varied based on, for example, a geometry of the orbiting scroll hub 65 (see FIGS. 3A-3C for additional discussion of the geometry of the orbiting scroll hub 65). In some embodiments, the inlet end 20A of the bearing housing drain 20 that receives the lubricant from the housing drain cavity 55 is disposed at about the same vertical location as the lower end of the orbiting scroll hub 65. The placement enables lubricant to drain from the housing drain cavity 55. A higher elevation for the inlet end 20A may cause lubricant to be pumped into the bearing housing drain 20 (and returned to the lubricant sump 100) instead of being provided to the thrust bearing 105. An outlet end 20B of the bearing housing drain 20 that is located relatively farther from the housing drain cavity 55 allows lubricant to flow toward the lubricant sump 100.

The bearing housing drain 20 is inclined with respect to a horizontal axis x at an angle $\alpha$. In some embodiments, the angle $\alpha$ can be at or about zero degrees to at or about 65 degrees (e.g., about $0 \leq \alpha \leq$ about 65). In some embodiments, an angle $\alpha$ of at or about 0 degrees may be the simplest to manufacture. The angle $\alpha$ can be selected to control an amount of lubricant that drains (e.g., via gravity) into the housing drain cavity 55 versus an amount of lubricant that drains (e.g., via gravity) into the lubricant sump 100. For example, a relatively shallow angle $\alpha$ allows lubricant to drain toward the lubricant sump 100. A relatively higher angle $\alpha$ reduces an amount of lubricant exiting the housing drain cavity 55. A relatively higher angle $\alpha$ allows lubricant to drain toward the housing drain cavity 55. In some embodiments, a higher angle $\alpha$ can increase reliability. Too high of an angle $\alpha$ can cause unwanted drag. The selection of the angle $\alpha$ also generally controls a steady-state lubricant volume in the housing drain cavity 55 during operation of the compressor 12.

In some embodiments, angling the bearing housing drain 20 at an angle $\alpha$ can provide lubricant to the thrust bearing 105 more quickly than if the lubricant is pumped from the lubricant sump 100 on compressor startup. For example, the bearing housing drain 20 being disposed at an angle $\alpha$ can enable a pool of lubricant to be maintained in the housing drain cavity 55, which can be pumped to the thrust bearing 105 on compressor startup. In some embodiments this can, for example, ensure proper lubrication of the components of the compressor 12 upon startup. Providing increased lubrication of the components of the compressor 12 can, for example, increase the lifetime of the compressor 12. Accordingly, the angle $\alpha$ can be selected to control a depth of lubricant pooled in the housing drain cavity 55 upon compressor shutdown that can be provided to the thrust bearing 105, or the like, upon compressor startup before the lubricant can be provided from the lubricant sump 100 via the lubricant pump 95.

The design of the bearing housing drain 20 (e.g., a diameter d, the distance y from the lower surface of the thrust bearing 105, and the angle $\alpha$) can be optimized to provide an optimal combination of lubricant delivery to bearings of the compressor 12, power draw of the compressor 12 during operation, and lubricant delivery time at startup of the compressor 12. In some embodiments, the optimal combination of the diameter d, the distance y, and the angle $\alpha$ can be selected for a particular compressor size and operating parameter.

Figure 3B:
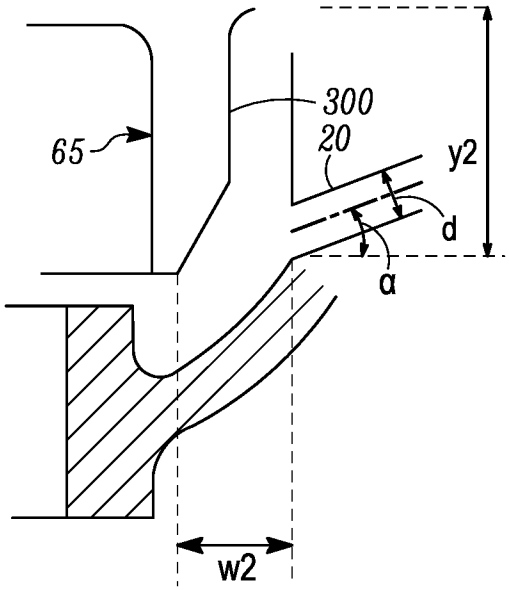
FIGS. 3A-3C illustrate various geometries for an outer surface of an orbiting scroll hub of a scroll compressor, according to some embodiments.
Figure 3A:
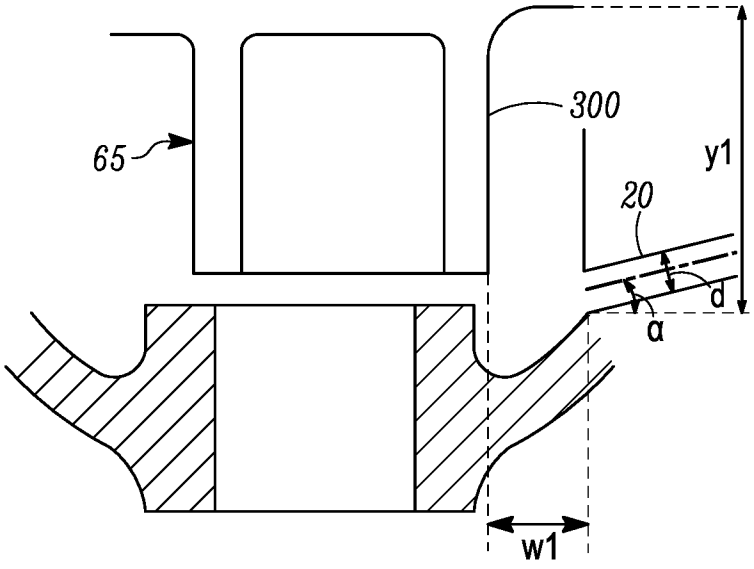
Figure 3C:
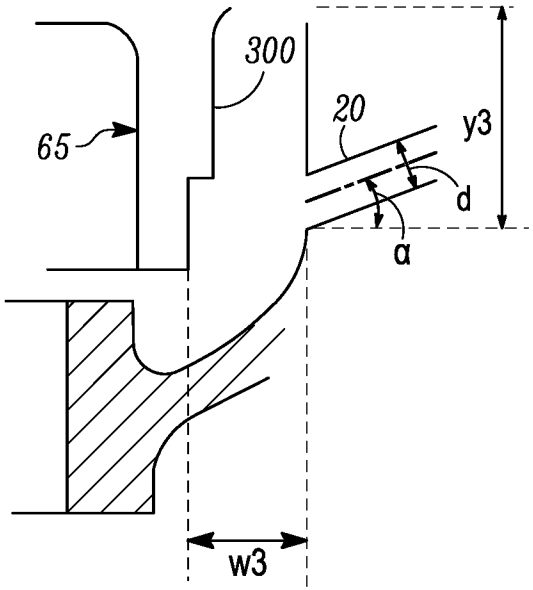

FIGS. 3A-3C illustrate various geometries for an outer surface 300 of the orbiting scroll hub 65 (FIG. 2), according to some embodiments. FIG. 3A illustrates the orbiting scroll hub 65 having an outer surface that is cylindrical, according to some embodiments. FIG. 3B illustrates the orbiting scroll hub 65 having an outer surface 300 that is tapered (e.g., chamfered), according to some embodiments. FIG. 3C illustrates the orbiting scroll hub 65 having an outer surface 300 that is stepped, according to some embodiments.

The bearing housing drain 20 is generally disposed in fluid communication with the housing drain cavity 55. In some embodiments, an inlet of the bearing housing drain 20 is disposed at a location proximate to the housing drain cavity 55 such that lubricant from the housing drain cavity 55 can flow into the bearing housing drain 20 when the compressor 12 is in operation. Further, with such placement, lubricant can drain from the bearing housing drain 20 toward the housing drain cavity 55 when the compressor is not in operation. An outlet of the bearing housing drain 20 is generally disposed at a location which is relatively vertically higher than the inlet, the relative vertical height being based on the angle $\alpha$ of the bearing housing drain 20.

In the illustrated embodiments, the bearing housing drain 20 is disposed a distance y1, y2, y3 from lower surface of the thrust bearing 105 (FIG. 2). The distances y1-y3 can vary due to the geometry of the outer surface 300 of the orbiting scroll hub 65. Generally, y1 may be greater than y2 and y3 and y2 may be greater than y3. The bearing housing drain 20 is generally at a distance w1, w2, w3 (in a left-right direction of FIG. 3) from the outer surface 300 of the orbiting scroll hub 65. In some embodiments, the distances w1-w3 can be the same. In some embodiments, the distances w1-w3 can be different. It will be appreciated that the distances w1-w3 may depend on, for example, the compressor 12 (FIG. 2) in which the bearing housing drain 20 is implemented. It will further be appreciated that a wall of the housing drain cavity 55 (FIG. 2) can be chamfered or stepped in place of the orbiting scroll hub 65.

Aspects:

It is to be appreciated that any of aspects 1-7 can be combined with any of aspects 8-14.

Aspect 1. A compressor, comprising:

a compressor housing;

a non-orbiting scroll member and an orbiting scroll member;

an orbiting scroll hub having an upper end and a lower end, the lower end being disposed at a vertical elevation that is lower than the upper end;

a thrust bearing;

a lubricant sump;

a housing drain cavity disposed within the compressor housing and configured to receive lubricant from a lubricant sump and to deliver the lubricant to the thrust bearing; and a bearing housing drain fluidly connected to the housing drain cavity and the lubricant sump.

Aspect 2. The compressor according to aspect 1, wherein a drain cavity end of the bearing housing drain is disposed in fluid communication with the housing drain cavity and is relatively lower in vertical elevation than a lower surface of the thrust bearing.

Aspect 3. The compressor according to any of aspects 1-2, wherein the bearing housing drain is disposed at an angle $\alpha$ with respect to a horizontal axis.

Aspect 4. The compressor according to aspect 3, wherein the angle $\alpha$ is between about 0 degrees and about 65 degrees.

Aspect 5. The compressor according to any of aspects 1-4, further comprising:

a driveshaft configured to drive the orbiting scroll;

a lubricant pump in fluid communication with the lubricant sump and configured to be driven by the driveshaft, wherein the driveshaft includes an opening for providing a lubricant from the lubricant sump to the housing drain cavity.

Aspect 6. The compressor according to any of aspects 1-5, wherein the compressor is a scroll compressor and the scroll compressor is one of a single-stage scroll compressor, a two-stage scroll compressor, and a scroll compressor that comprises more than two stages of compression.

Aspect 7. The compressor according to any of aspects 1-6, wherein the compressor is a vertical scroll compressor.

Aspect 8. A heat transfer circuit, comprising:

a compressor, a condenser, an expansion device, and an evaporator fluidly connected, wherein the compressor includes:

a compressor housing;

a non-orbiting scroll member and an orbiting scroll member;

an orbiting scroll hub having an upper end and a lower end, the lower end being disposed at a vertical elevation that is lower than the upper end;

a thrust bearing;

a lubricant sump;

a housing drain cavity disposed within the compressor housing and configured to receive lubricant from a lubricant sump and to deliver the lubricant to the thrust bearing; and a bearing housing drain fluidly connected to the housing drain cavity and the lubricant sump.

Aspect 9. The heat transfer circuit according to aspect 8, wherein the compressor further comprises:

a drain cavity end of the bearing housing drain is disposed in fluid communication with the housing drain cavity and is relatively lower in vertical elevation than a lower surface of the thrust bearing.

Aspect 10. The heat transfer circuit according to any of aspects 8-9, wherein the bearing housing drain is disposed at an angle $\alpha$ with respect to a horizontal axis.

Aspect 11. The heat transfer circuit according to aspect 10, wherein the angle $\alpha$ is at or about 0 degrees to at or about 65 degrees.

Aspect 12. The heat transfer circuit according to any of aspects 8-11, further comprising:

a driveshaft configured to drive the orbiting scroll;

a lubricant pump in fluid communication with the lubricant sump and configured to be driven by the driveshaft, wherein the driveshaft includes an opening for providing a lubricant from the lubricant sump to the housing drain cavity.

Aspect 13. The heat transfer circuit according to any of aspects 8-12, wherein the scroll compressor is one of a single-stage scroll compressor, a two-stage scroll compressor, and a scroll compressor that comprises more than two stages of compression.

Aspect 14. The heat transfer circuit according to any of aspects 8-13, wherein the compressor is a vertical scroll compressor.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, indicate the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts, without departing from the scope of the present disclosure. The word "embodiment" as used within this specification may, but does not necessarily, refer to the same embodiment. This specification and the embodiments described are examples only. Other and further embodiments may be devised without departing from the basic scope thereof, with the true scope and spirit of the disclosure being indicated by the claims that follow.

What is claimed is:

1. A method of controlling lubrication in a scroll compressor, the scroll compressor including a compressor housing; a non-orbiting scroll member and an orbiting scroll member; an orbiting scroll hub having an upper end and a lower end and a length from the upper end to the lower end, the lower end of the orbiting scroll hub being disposed at a vertical elevation that is lower than the upper end of the orbiting scroll hub; a driveshaft configured to drive the orbiting scroll member; a thrust bearing; a lubricant sump; a housing drain cavity having an upper end and a lower end, the housing drain cavity being disposed within the compressor housing and configured to receive lubricant from the lubricant sump and to deliver the lubricant to the thrust bearing; and a bearing housing drain fluidly connected to the housing drain cavity and the lubricant sump, the bearing housing drain having an inlet end and an outlet end, the inlet end of the bearing housing drain being disposed a first distance from the thrust bearing in a direction along the driveshaft, the outlet end being disposed a second distance from the thrust bearing in the direction along the driveshaft, the first distance being greater than the second distance, and the first distance being greater than the length from the upper end of the orbiting scroll hub to the lower end of the orbiting scroll hub, the outlet end of the bearing housing drain being lower than the upper end of the housing drain cavity, the method comprising:

directing the lubricant from the housing drain cavity toward the thrust bearing and the orbiting scroll member;

directing the lubricant from a lubricant pool in the housing drain cavity through the bearing housing drain; and directing the lubricant from the bearing housing drain to the lubricant sump.

2. The method according to claim 1, wherein directing the lubricant from the housing drain cavity through the bearing housing drain includes controlling an angle of the bearing housing drain relative to a horizontal axis.

3. The method according to claim 2, wherein controlling the angle of the bearing housing drain includes selecting the angle to enable lubricant draining to the lubricant sump while reducing an amount of drag.

4. The method according to claim 2, wherein controlling the angle of the bearing housing drain controls a steady-state lubricant volume in the housing drain cavity.

5. The method according to claim 2, wherein controlling the angle includes setting the angle to be inclined from about 0° to about 65° relative to the horizontal axis.

6. A compressor, comprising:

a compressor housing;

a non-orbiting scroll member and an orbiting scroll member;

an orbiting scroll hub having an upper end and a lower end and a length from the upper end to the lower end, the lower end of the orbiting scroll hub being disposed at a vertical elevation that is lower than the upper end of the orbiting scroll hub;

a driveshaft configured to drive the orbiting scroll member;

a thrust bearing;

a lubricant sump;

a housing drain cavity having an upper end and a lower end, the housing drain cavity being disposed within the compressor housing and configured to receive lubricant from the lubricant sump and to deliver the lubricant to the thrust bearing; and a bearing housing drain fluidly connected to the housing drain cavity and the lubricant sump, wherein the bearing housing drain receives a lubricant flow from the housing drain cavity at an inlet end, and a portion of the lubricant flow is directed from the housing drain cavity through the bearing housing drain to an outlet end, and the bearing housing drain is configured to control a steady-state lubricant volume in the housing drain cavity, the inlet end of the bearing housing drain being disposed a first distance from the thrust bearing in a direction along the driveshaft, the outlet end being disposed a second distance from the thrust bearing in the direction along the driveshaft, the first distance being greater than the second distance, and the first distance being greater than the length from the upper end of the orbiting scroll hub to the lower end of the orbiting scroll hub, wherein the outlet end of the bearing housing drain is lower than the upper end of the housing drain cavity.

7. The compressor according to claim 6, wherein the inlet end of the bearing housing drain is disposed in fluid communication with the housing drain cavity and is relatively lower in vertical elevation than a lower surface of the thrust bearing.

8. The compressor according to claim 6, wherein the bearing housing drain is disposed at an angle $\alpha$ with respect to a horizontal axis.

9. The compressor according to claim 8, wherein the angle $\alpha$ is between about 0 degrees and about 65 degrees.

10. The compressor according to claim 6, further comprising:

a lubricant pump in fluid communication with the lubricant sump and configured to be driven by the driveshaft, wherein the driveshaft includes an opening for providing a lubricant from the lubricant sump to the housing drain cavity.

11. The compressor according to claim 6, wherein the compressor is a scroll compressor and the scroll compressor is one of a single-stage scroll compressor, a two-stage scroll compressor, and a scroll compressor that comprises more than two stages of compression.

12. The compressor according to claim 6, wherein the compressor is a vertical scroll compressor.

13. A heat transfer circuit, comprising:

a compressor, a condenser, an expansion device, and an evaporator fluidly connected, wherein the compressor includes:

a compressor housing;

a non-orbiting scroll member and an orbiting scroll member;

an orbiting scroll hub having an upper end and a lower end and a length from the upper end to the lower end, the lower end of the orbiting scroll hub being disposed at a vertical elevation that is lower than the upper end of the orbiting scroll hub;

a driveshaft configured to drive the orbiting scroll member;

a thrust bearing;

a lubricant sump;

a housing drain cavity having an upper end and a lower end, the housing drain cavity being disposed within the compressor housing and configured to receive lubricant from the lubricant sump and to deliver the lubricant to the thrust bearing; and a bearing housing drain fluidly connected to the housing drain cavity and the lubricant sump, wherein the bearing housing drain receives a lubricant flow from the housing drain cavity at an inlet end and a portion of the lubricant flow is directed from the housing drain cavity through the bearing housing drain to an outlet end, and the bearing housing drain is configured to control a steady-state lubricant volume in the housing drain cavity, the inlet end of the bearing housing drain being disposed a first distance from the thrust bearing in a direction along the driveshaft, the outlet end being disposed a second distance from the thrust bearing in the direction along the driveshaft, the first distance being greater than the second distance, and the first distance being greater than the length from the upper end of the orbiting scroll hub to the lower end of the orbiting scroll hub, wherein the outlet end of the bearing housing drain is lower than the upper end of the housing drain cavity.

14. The heat transfer circuit according to claim 13, wherein the inlet end of the bearing housing drain is disposed in fluid communication with the housing drain cavity and is relatively lower in vertical elevation than a lower surface of the thrust bearing.

15. The heat transfer circuit according to claim 13, wherein the bearing housing drain is disposed at an angle $\alpha$ with respect to a horizontal axis.

16. The heat transfer circuit according to claim 15, wherein the angle $\alpha$ is about 0 degrees to at or about 65 degrees.

17. The heat transfer circuit according to claim 13, further comprising:

a lubricant pump in fluid communication with the lubricant sump and configured to be driven by the driveshaft, wherein the driveshaft includes an opening for providing a lubricant from the lubricant sump to the housing drain cavity.

18. The heat transfer circuit according to claim 13, wherein the scroll compressor is one of a single-stage scroll compressor, a two-stage scroll compressor, and a scroll compressor that comprises more than two stages of compression.

19. The heat transfer circuit according to claim 13, wherein the compressor is a vertical scroll compressor.

* * * * *